US005354646A

United States Patent [19]

Kobayashi et al.

[11] Patent Number: 5,354,646

[45] Date of Patent: Oct. 11, 1994

[54] METHOD CAPABLE OF RAPIDLY PROCESSING A SILVER HALIDE COLOR PHOTOGRAPHIC LIGHT-SENSITIVE MATERIAL

[75] Inventors: Kazuhiro Kobayashi, Inagi; Shigeharu Koboshi, Sagamihara; Masao Ishikawa, Tama; Masayuki Kurematsu, Hino; Yoko Matsushima, Hachioji, all of Japan

[73] Assignee: Konishiroku Photo Industry Co., Ltd., Tokyo, Japan

[21] Appl. No.: 206,283

[22] Filed: Mar. 7, 1994

Related U.S. Application Data

[63] Continuation of Ser. No. 974,489, Nov. 12, 1992, abandoned, which is a continuation of Ser. No. 384,051, Jul. 24, 1989, abandoned, which is a continuation of Ser. No. 149,224, filed as PCT/JP87/00181, Mar. 25, 1987, abandoned.

[30] Foreign Application Priority Data

Mar. 26, 1986 [JP] Japan ..... 61-67949

[51] Int. Cl.[5] ..... G03C 7/30

[52] U.S. Cl. ..... 430/372; 430/380; 430/467; 430/468; 430/469; 430/484; 430/485; 430/490; 430/487; 430/963

[58] Field of Search ..... 430/372, 380, 467–469, 430/250, 484, 485, 488, 490, 963, 487

[56] References Cited

U.S. PATENT DOCUMENTS

| | | |
|---|---|---|
| 1,939,201 | 12/1936 | Brooker . |
| 2,072,908 | 3/1937 | Schneider . |
| 2,213,995 | 9/1940 | Riester et al. . |
| 2,231,658 | 2/1941 | Brooker et al. . |
| 2,269,234 | 1/1942 | Sprague . |
| 2,270,378 | 1/1942 | Middleton et al. . |
| 2,274,782 | 3/1942 | Gaspar . |
| 2,369,929 | 2/1946 | Vittum . |
| 2,434,272 | 1/1948 | Jelley et al. . |
| 2,442,710 | 6/1948 | Reister . |
| 2,454,629 | 11/1948 | Brooker . |

(List continued on next page.)

FOREIGN PATENT DOCUMENTS

| | | |
|---|---|---|
| 148441 | 7/1985 | European Pat. Off. . |
| 50-123342 | 9/1975 | Japan . |
| 51-10783 | 4/1976 | Japan . |
| 51-77223 | 7/1976 | Japan . |
| 51-102636 | 9/1976 | Japan . |
| 56-18939 | 5/1981 | Japan . |
| 56-64339 | 6/1981 | Japan . |
| 57-144547 | 9/1982 | Japan . |
| 58-50534 | 3/1983 | Japan . |
| 58-50535 | 3/1983 | Japan . |
| 58-50536 | 3/1983 | Japan . |
| 58-184142 | 10/1983 | Japan . |
| 59-184341 | 10/1984 | Japan . |
| 62-65040 | 3/1987 | Japan . |
| 62-180369 | 8/1987 | Japan . |
| 474093 | 6/1969 | Switzerland . |

OTHER PUBLICATIONS

Supplementary European Search Report.

Patent Abstracts of Japan for JPA 53–32035.

*Primary Examiner*—Richard L. Schilling

*Attorney, Agent, or Firm*—Finnegan, Henderson, Farabow, Garrett & Dunner

[57] ABSTRACT

A method of colour-developing a silver halide colour light-sensitive material having plural silver halide emulsion layers each containing substantially silver chlorobromide. At least one of the layers has a silver chloride content of not less than 20 mol %, and a colour developer being used in the colour developing method contains the compounds each represented by the following formula [I]:

Formula [I]

According to the processing method, a colour photographic image having a satisfactory colour density can be obtained by a rapid development process and the excellent preservability for a long standing of the colour developer can be displayed.

3 Claims, No Drawings

U.S. PATENT DOCUMENTS 2,474,293 6/1949 Weissberger et al. .
2,493,748 1/1950 Brooker et al. .
2,503,776 4/1950 Sprague .
2,519,001 8/1950 Sprague .
2,521,908 9/1950 Glass et al. .
2,533,472 12/1950 Keyes et al. .
2,600,788 6/1952 Loria et al. .
2,739,149 3/1956 Van Lare .
2,761,791 9/1956 Russell .
2,776,280 1/1957 Brooker et al. .
2,895,826 7/1959 Salminen et al. .
2,912,329 11/1959 Jones et al. .
2,941,898 6/1960 Wynn .
2,945,763 7/1960 Jones .
2,956,879 10/1960 Van Campen .
2,983,608 5/1961 Beavers .
3,034,892 5/1962 Gledhill et al. .
3,062,653 11/1962 Weissberger et al. .
3,117,078 1/1964 Gossett .
3,125,448 3/1964 Heseltine et al. .
3,127,269 3/1964 Greenhalgh et al. .
3,148,187 9/1964 Heseltine .
3,247,127 4/1966 Bailey .
3,260,601 7/1966 Bailey .
3,287,124 11/1966 Green et al. ..... 430/435
3,287,125 11/1966 Green et al. ..... 430/435
3,293,034 12/1966 Green et al. ..... 430/435
3,311,476 3/1967 Loria .
3,419,391 12/1968 Young .
3,458,315 7/1969 Loria .
3,476,563 11/1969 Loria .
3,519,429 7/1970 Lestina .
3,540,887 11/1970 Depoorter et al. .
3,558,319 1/1971 Hamaoka et al. .
3,575,704 4/1971 Salesin .
3,582,322 6/1971 Edens et al. .
3,583,971 6/1971 Yoshida et al. .
3,591,388 7/1971 Cornelis et al. .
3,615,506 10/1971 Abbott et al. .
3,653,905 4/1972 Depoorter et al. .
3,656,959 4/1972 Kimura et al. .
3,672,897 6/1972 Sato et al. .
3,694,217 9/1972 Sakaguchi et al. .
3,718,472 2/1973 Oliver et al. .
3,767,411 10/1973 Kishimoto et al. .
3,772,002 11/1973 Ramello .
3,834,908 9/1974 Hara et al. .
3,891,445 6/1975 Arai et al. .
3,929,484 12/1975 Ross ..... 260/562 R
3,933,494 1/1976 Busatto et al. .
4,004,929 1/1977 Orvis .
4,025,349 5/1977 Mee .
4,046,572 9/1977 Hinata et al. .
4,071,312 1/1978 Blackwell ..... 8/7
4,071,352 1/1978 Arneklev et al. ..... 71/100
4,155,763 5/1979 Hasebe et al. ..... 430/490
4,299,913 11/1981 Wernicke ..... 430/490
4,482,626 11/1984 Twist et al. ..... 430/490
4,585,728 4/1986 Furutachi et al. ..... 430/372
4,621,041 11/1986 Saikawa et al. ..... 430/567
4,801,516 1/1989 Ishikawa et al. ..... 430/380
4,837,139 6/1989 Kobayashi et al. ..... 430/542
4,892,804 1/1990 Vincent et al. ..... 430/380
4,897,339 1/1990 Andoh et al. ..... 430/372

METHOD CAPABLE OF RAPIDLY PROCESSING A SILVER HALIDE COLOR PHOTOGRAPHIC LIGHT-SENSITIVE MATERIAL

This application is a continuation, of application Ser. No. 07/974,489 filed Nov. 12, 1992, now abandoned, which is a continuation of application Ser. No. 07/384,051 filed Jul. 24, 1989, abandoned, which is a continuation of application Ser. No. 07/149,224, filed as PCTJP87/00181, Mar. 25, 1987, abandoned.

FIELD OF TECHNOLOGY

This invention relates to a method of processing a silver halide colour photographic light-sensitive material and, more particularly, to a method of processing a silver halide colour photographic light-sensitive material, in which a color developer can be excellent in the storage of long standing and a maximum colour density can satisfactorily be obtained and, further, a rapid development can be made.

BACKGROUND OF TECHNOLOGY

Recently in this field of industry, there have been demands for such a technology as is capable of rapidly processing silver halide colour photograpic light-sensitive materials and is also capable of obtaining a stable photographic characteristics together with an excellent processing stability and, in particular, for a method of rapidly developing silver halide colour photographic light-sensitive materials.

Namely, silver halide colour photographic light-sensitive materials have been subjected to running treatments with an automatic processing apparatus installed at each photo-finishing laboratory. In these systems, however, it has been requested, as one of service improvements to users, to process users' photographic products and return the finished ones to them, within not only the same day when the photo-finishing orders were received and, but also several hours after receiving orders, recently, so that a rapid processing technolgy has been urgently demanded.

With respect to the conventional technologies for rapidly processing silver halide colour photographic light-sensitive materials, they may be roughly classified into the following three technologies:

[1] Technologies devised by the improvements in silver halide colour photographic light-sensitive materials.

[2] Technologies devised by making use of a physical means in a development process, and

[3] Technologies devised by the improvements in the composition of a processing liquid used in a develoment process.

Concerning the above-mentioned technologies [1], there are known technologies including (1) the improvements of silver halide compositions (for example, a technology of making silver halide grains finer, such as described in Japanese Patent Publication Open to Public Inspection (hereinafter called Japanese Patent O.P.I. Publication) No. 77223-1976, and the technologies of making a silver bromide content of silver halide lesser, such as described in Japanese Patent O.P.I. Publication No. 184142-1983 and Japanese Patent Examined publication No. 18939-1981); (2) the utilization of additives (for example, the technology of adding silver halide colour photographic light-sensitive materials with a specifically structured 1-aryl-3-pyrazolidone, such as described in Japanese Patent O.P.I. Publication No. 64339-1981, and the technologies of adding silver halide colour photographic light-sensitive materials with 1-aryl-pyrazolidones, such as described in Japanese Patent O.P.I. Publication Nos. 144547-1982, 50534-1983, 50535-1983 and 50536-1983); (3) the technologies of adding a high-speed reaction type coupler (for example, the technologies of using a high-speed reaction type yellow coupler, such as described in Japanese Patent Examined Publication No. 10783-1976 and Japanese Patent O.P.I. Publication Nos. 123342-1975 and 102636-1976); (4) the technology of thinning a photographic component layer (for example, the technology of thinning a photographic component layer, such as described in Japanese Patent Application No. 204992-1985); and so forth.

Concerning the above-mentioned technologies [2], there include a technology of stirring a processing liquid (for example, the technology of stirring a processing liquid, such as described in Japanese Patent Application No. 23334-1986;

Concerning the above-mentioned technologies [3], there include (1) the technology of using a development accelerator: (2) the technology of thickening a colour developing agent: (3) the technology of lowering the concentration of halogen ions and, particularly, bromide ions; and so forth.

This invention relates to the above-mentioned technologies [1] and [3] out of those [1], [2] and [3].

Among the silver halide colour photographic light-sensitive materials, the so-called light-sensitive materials for colour paper use generally contain silver chlorobromide as the silver halide composition thereof. Particularly in silver halide colour photographic light-sensitive materials in which the silver bromide content mentioned in the above technology (1) of [1] is reduced, that is, the silver chloride content is increased, a development may be accelerated by themselves and the bromide ion concentration of a developer may also be reduced when a running treatment is kept on successively, so that the light-sensitive materials may have the characteristics that a development acceleration may readily be made and a low quantity replenishment of developer may also be possible.

The present inventors have studied on the methods of processing silver halide colour photographic light-sensitive materials having the above-mentioned silver halide content reduced suitably for paper use, and resultingly found that, while these light-sensitive materials may be processed more rapidly than the conventional type silver halide colour photographic light-sensitive materials using silver chlorobromide having a high silver bromide content (such as a 90 mol % silver bromide content), there is a problem that a maximum colour density, that is one of the most essential characteristics of light-sensitive materials, is lowered. With the purpose of further rapidly processing silver halide colour photographic light-sensitive materials, for example, when a silver bromide content is further reduced or a silver chloride content is increased, and the developing conditions are changed, for example, a pH and a temperature are raised or, further, a bromide ion concentration of a processing liquid is lowered, the above-mentioned maximum colour density is further remarkably lowered under the above-mentioned conditions.

Conventionally, colour developers each contain an aromatic primary amine type colour developing agent such as paraphenylenediamine and so forth, hydroxylamine and sulfites used as a preservative for preventing the air-oxidation and so forth of the colour developing agent, benzyl alcohol for accelerating colour developments, other additives, and so forth. As a result of studying these components of a colour developer, the inventors have found that the hydroxylamine contained in the components was the substance lowering the above-mentioned maximum colour density. Though the reason of this fact is not clear, it may be considered that, when a colour development is made, hydroxylamine itself reacts as a reducing agent of an exposed silver halide so as to interfere a colour developing reaction that ought to have reacted the exposed silver halide with a colour developing agent to produce the oxidized products of the colour developing agent and then reacted to couple the oxidized products to couplers and, resultingly, a maximum colour density is lowered.

The inventors have also studied on the system using only a sulfite not any hydroxylamine as the preservative. Resultingly, the standing stability of the colour developer tested was maintained to some extent, however, an dye image was fogged seriously when processed with a long-stored colour developer.

It has generally been considered that a fog production may colosely relate to the deterioration of a colour developer used. Fogs are particularly liable to be produced when raising a pH of a colour developer, a temperature for colour development process and a concentration of the colour developing agent contained in a colour developer, or when prolonging a storage of long standing of a colour developer. Therefore, the main cause of fog production is supposed to be the decomposed or oxidized products produced by partly decomposing or oxidizing the colour developing agent of the colour developer. The above-mentioned decomposed or oxidized products of color developing agents include, for example, a semiquinone or quinoneimine that is an oxidized product of a colour developing agent, a paraaminophenol produced by receiving a deamination reaction or a quinonemonoimine that is the oxidized product thereof, the sulfurous acid addition products of quinonediimine or the quinonmonoimine or the oxidized products thereof, and so forth. Some of these products make a coupling reaction with couplers upon oxidizing silver halide present in the unexposed areas of a light-sensitive material or make a coupling reaction directly with couplers so as to form a dye in the regions of the unexposed areas of a colour photographic light-sensitive material, where any dye ought not to be formed, and fogs are produced in white regions. And, for example, in a light-sensitive material comprising three emulsion layers, i.e., blue-, green- and red-sensitive layers, when one or two of these layers are exposed to light, the fog production on each unexposed layer will appear in a mixed colour, so that these fogs and the mixed colour will seriously deteriorate a photographic image quality.

Accordingly, the present inventors have studied on the methods of processing silver halide colour photographic light-sensitive materials capable of maintaining the preservability of a colour developer, inhibiting fogs and, particularly, preventing a maximum colour density from lowering and, further, suitable for a rapid processing. Resultingly, the inventors have found the fact that the above-mentioned problems can be solved by processing the silver halide colour photographic light-sensitive materials each having a specific silver halide composition, in the presence of a specific preservative, so that this invention has finally been achieved.

It is, therefore, an object of this invention to provide a method of processing a silver halide colour photographic light-sensitive material, in which the photographic characteristics cannot be deteriorated by fog and so forth, a colour developer is excellent in long standing stability and, particularly, a maximum colour density of a dye image obtained is also excellent and, further, a rapid processing can be performed.

DISCLOSURE OF THE INVENTION

The above-mentioned object of the invention can be achieved in a method of processing a silver halide colour photographic light-sensitive material having a plurality of silver halide emulsion layers in at least a colour developing step after exposed imagewise to light; characterized in that (1) Silver halides each contained in the above-mentioned plurality of the silver halide emulsion layers are substantially silver chlorobromide, (2) At least one layer out of the above-mentioned plurality of the silver halide emulsion layers contains silver chlorobromide having a silver chloride content of not less than 20 mol %, and (3) A colour developer used in the above-mentioned colour developing step contains at least one kind of the compounds each represented by the following Formula [I]:

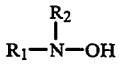

Formula [I]

(wherein $R_1$ and $R_2$ each represent a hydrogen atom or an alkyl or alkoxy group having 1 to 3 carbon atoms, provided that $R_1$ and $R_2$ are not hydrogen atoms at the same time, and $R_1$ and $R_2$ are allowed to couple to each other so as to complete a ring).

THE BEST MODE CONTEMPLATED BY THE APPLICANT FOR CARRYING OUT THE INVENTION CLAIMED

In the colour developers of the invention, the compounds represented by Formula [I] (hereinafter called the compounds of the invention) are used as the preservatives.

In Formula [I], $R_1$ and $R_2$ each represent a hydrogen atom or an alkyl or alkoxy group having 1 to 3 carbon atoms. The alkyl groups each having 1 to 3 carbon atoms represented by $R_1$ and $R_3$ include those each having substituents including, for example, a hydroxyl group, an amino group, an alkoxy group, a sulfonic acid group, a carboxylic acid group, a halogen atom (such as a chlorine atom, a fluorine atom, a bromine atom and so forth), and an alkenyl group (such as an allyl group and so forth). The typical examples of the alkyl groups each represented by $R_1$ and $R_2$ include a methyl group, an ethyl group, a hydroxyethyl group, an i-propyl group, a n-propyl group and so forth. The alkoxy groups each represented by $R_1$ and $R_2$ include, for example, a methoxy group, an ethoxy group and so forth.

Concerning the above-mentioned groups, there are descriptions in, for example, U.S. Pat. Nos. 3,287,125, 3,293,034, 3,287,124 and so forth.

However, $R_1$ and $R_2$ shall not be hydrogen atoms at the same time, and $R_1$ and $R_2$ are allowed to couple to each other to complete such a ring as the heterocyclic rings of piperidine or morpholine, and so forth.

It is preferred that both of $R_1$ and $R_2$ should be alkyl groups each having 1 to 3 carbon atoms.

The typical examples of the compounds of the invention used in the invention will be exemplified below, however, to be understood that the invention shall not be limited thereto.

Exemplified Compounds (1) $CH_3-N(CH_3)-OH$ (2) $C_2H_5-N(CH_3)-OH$ (3) $C_2H_5-N(C_2H_5)-OH$ (4) $(iso)C_3H_7-N(CH_3)-OH$ (5) $(n)C_3H_7-N(C_2H_5)-OH$ (6) $(n)C_3H_7-N(C_3H_7)-OH$ (7) $H-N(CH_3)-OH$ (8) $H-N(C_2H_5)-OH$ (9) $CH_3-N(OCH_3)-OH$

(10) $C_2H_5-N(OCH_3)-OH$

(11) $H-N(OC_2H_5)-OH$

(12) $CH_3-N(C_2H_4OH)-OH$

(13) $(CH_2-CH_2)_2N-OH$

(14) $(iso\text{-}C_3H_7)_2N-OH$

(15) $(C_2H_5)(iso\text{-}C_3H_7)N-OH$

(16) $(CH_3-O-C_2H_4)(C_2H_5)N-OH$

(17) $(HOC_2H_4)_2N-OH$

(18) $(HO_3S-C_2H_4)(C_2H_5)N-OH$

(19) $(HOOC-C_2H_4)_2N-OH$

(20) 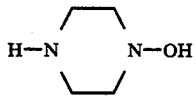

(21) 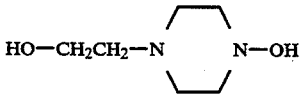

(22) 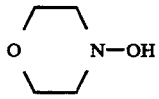

(23) 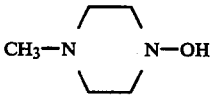

(24) 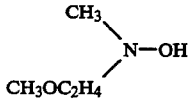

-continued

Exemplified Compounds

(25) $(CH_3OC_2H_4)_2N-OH$

(26) $(HO_3SC_2H_4)_2N-OH$

(27) $(C_2H_5OC_2H_4)_2N-OH$

(28) $(HO_3SC_3H_6)_2N-OH$

(29) $(NH_2C_3H_6)_2N-OH$

(30) $HO-CH_2-NH-OH$

(31) $CH_3-O-C_2H_4-NH-OH$

(32) $HO-C_2H_4-NH-OH$

(33) $HOOC-C_2H_4-NH-OH$

(34) $HO_3S-C_2H_4-NH-OH$

(35) $N_2H-C_3H_6-NH-OH$

(36) $CH_3-O-C_2H_4-NH-OH$

The above-exemplified compounds of the invention are usually used in the form of salts such as a chloride, a sulfate, a p-toluene sulfate, an oxalate, a phosphate, an acetate and so forth.

The concentration of the compounds of the invention used in a colour developer is of the same degree as that of hydroxylamine usually used as a preservative. The concentration thereof is, preferably, from 0.5 g per liter to 50 g per liter and, more preferably, from 1 g per liter to 20 g per liter.

As for the colour developing agents used in the colour developers of the invention, it is allowed to use any of the aromatic primary amine type colour developing agent which are usually used. However, from the viewpoints of maintaining the stability of long standing of the colour developers and reducing fogs produced on dye images obtained through a development or from other viewpoints each taken in the combination of the colour developing agents with the compounds of the invention serving as the above-mentioned preservatives, such colour developing agents are preferably a paraphenylenediamine type colour developing agent having at least one water-soluble group (i.e., a hydrophilic group) on the amino group or the benzene nucleus thereof. The above-mentioned water-soluble groups substituted onto the amino group or the benzene nucleus include, preferably, the following groups:

$-(CH_2)_n-CH_2OH$, $-(CH_2)_m-NHSO_2-(CH_2)_n-CH_3$, $-(CH_2)_mO-(CH_2)_n-CH_3$, $-(CH_2CH_2O)_nC_mH_{m+1}$ (in which m and n each are an integer of not less than 0), and a —COOH group, a $-SO_3H$ group and so forth may be preferably given as the examples thereof.

The most preferable ones are $(CH2)_m NHSO_2 (CH_2)_n CH_3$ (in which m and n each are an integer of from 0 to 5).

The typical examples of the colour developing agents preferably used in the invention will be given below and it is, however, to be understood that the invention shall not be limited thereto.
Exemplified colour developing agents
(1)
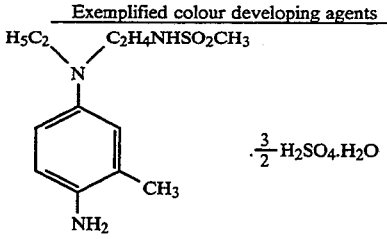
(2)
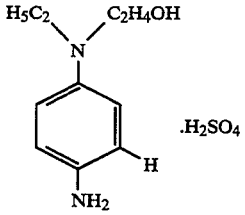
(3)
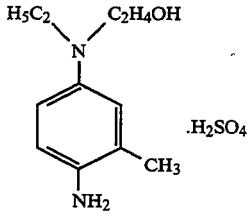
(4)
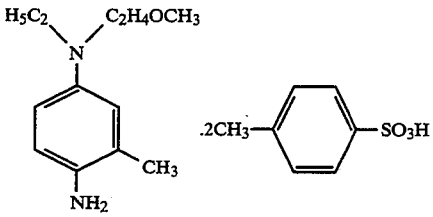
(5)
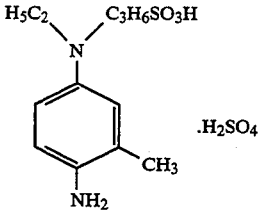
(6)
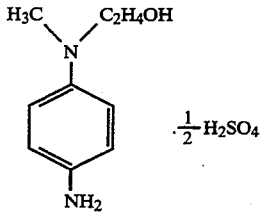
(7)
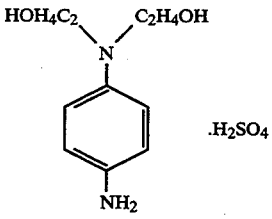
-continued
Exemplified colour developing agents
(8)
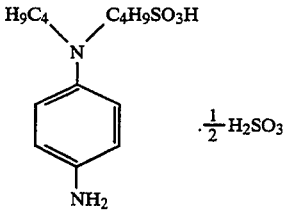
(9)
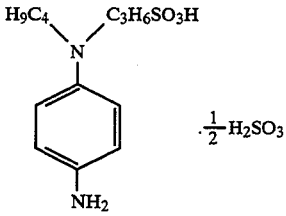
(10)
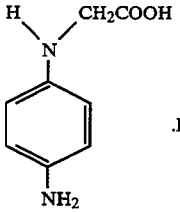
(11)
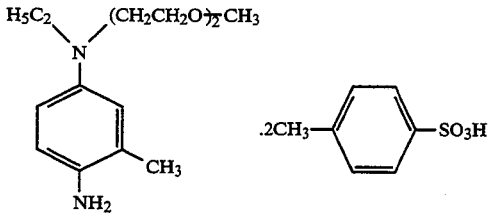
(12)
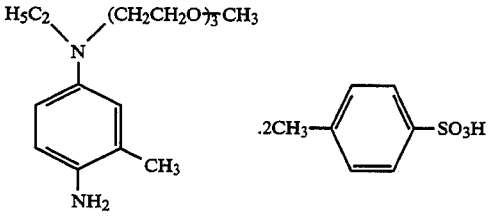
(13)
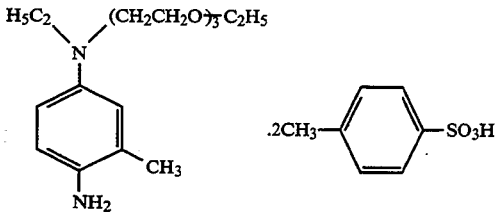
(14)
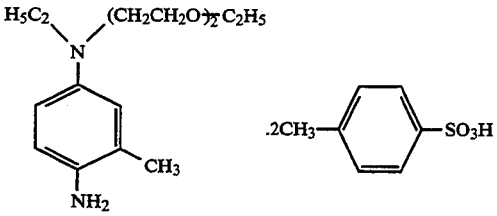

-continued

Exemplified colour developing agents (15)

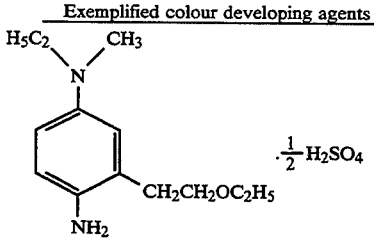

(16)

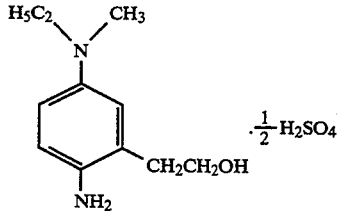

(17)

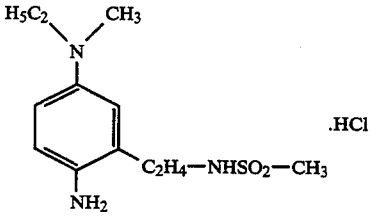

(18)

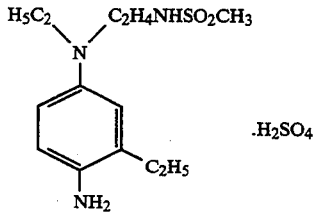

The above-mentioned colour developing agents are usually used within the range of, preferably, from 1 g to 100 g per liter of a colour developer used and, more preferably, from 3 g to 50 g.

In the colour developers of the invention, ions of a romide are used in the form of potassium bromide or the like, as an antifogging agent. Basically from the viewpoint of rapid processing, the concentration of the bromide ions is the lower, the better, because a developing time may also shortened. On the other hand, a fog production is increased, because the antifogging effect is decreased. However, in the method of the invention which will be mentioned later, for processing, with the compound of the invention, a silver halide colour photographic light-sensitive material having at least one silver halide emulsion layer whose silver chloride content is increased, no fog is increased even if the bromide ion concentration is lowered, that is preferable. In the invention, the bromide ion concentration is preferably not more than $1.3\times10^{-2}$ mol per liter, more preferably not more than $8.4\times10^{-3}$ mol per liter and, especially not more than $3.0\times10^{-3}$.

The colour developers used in the invention are allowed to contain arbitrarily various components usually added thereto, including, for example, alkalizing agents such as sodium hydroxide, sodium carbonate and so forth, an alkali-metal sulfite, an alkali-metal hydrogensulfite, an alkali-metal thiocyanate, an alkali-metal halide, a polystyrene sulfonic acid, a water softener, benzyl alcohol, ethylene glycol, diethylene glycol, triethanolamine, a thickening agent, a development accelerator, and so forth.

Besides the above, the other additives which may be added into the above-mentioned colour developers include, for example, firstly, the compounds for rapid processing liquids such as alkali iodides, nitrobenzoimidazole, mercaptobenzoimidazole, 5-methyl-benzotriazole, 1-phenyl-5-mercaptotetraazole and so forth and, secondly, antistaining agents, sludge preventing agents, interlayer effect accelerators, chelating agents and so forth. The chelating agents mainly used in developers include, for example, an aminopolycarboxylate and an organic phosphonate.

Among the above-mentioned additives, the badly soluble organic solvents particularly represented by benzyl alcohol are liable to produce tar when a color developer is used for a long period of time and, especially, in a low replenishment type running process and such tar adheres to a light-sensitive paper being processed. In addition, a fatal trouble may sometimes be caused to seriously damage the commercial value of the paper.

The badly soluble organic solvents have a poor solubility to water, therefore, there are not only the trouble of preparing a colour developer itself with a stirrer, but also a limitation to the development acceleration effect even if the stirrer is used due to the poor solubility of the solvent.

Further, the badly soluble organic solvents have such a problem that they have a great pollutant load in biochemical oxygen demand (BOD) and so forth and it is not permitted to dispose to sewage works, rivers and so forth and, therefore, many labor and expenses are needed for the waste disposal. Accordingly, it is preferred to reduce or eliminate the use of such solvents as best we can. The processing method of the invention may also be applied to a system containing benzyl alcohol, however, from the viewpoint of a rapid processing, one of the preferable embodiments is a system not containing any benzyl alcohol.

It is preferable to use the colour developers of the invention at a pH value of not lower than 9.90 and, usually, at a pH value of not higher than 13, because the upper limit of the pH values relates to the fog produced in a dye image. It is generally known that a rapid processing can be performed by making the pH value of a colour developer higher to some extent. However, when a processing is made with a long standing colour developer, a fog increase cannot be neglected. In the processing method of the invention, it was found such an unexpected effect that, when the compounds of the invention were used as preservatives, there was none of the fog increase which has been liable to produce when making a pH value of a colour developer higher and has hereto fore been considered to cause the deterioration in the long standing stability of a colour developer. This fact indicates that a processing can be performed at a pH range more higher than the pH range heretofore in use and that the method of the invention is suitable for a rapid processing.

In the method of the invention for processing silver halide colour photographic light-sensitive materials, the processing temperature used therein is the higher, the more preferable, provided that it is within the range of from not lower than 30° C. to not higher than 50° C., because a rapid processing can be made. However, from the viewpoints of the long standing stability of a colour developer, a fog production and so forth, it is preferable that a processing should be made at a temperature of not too higher but from not lower than 33° C. to not higher than 45° C.

In the method of the invention for processing silver halide colour photographic light-sensitive materials, any system can be applied thereto, provided that such system uses a colour developer containing the aforementioned compounds of the invention. These systems include, for example, firefly, a monobath processing system and, secondly, various other systems such as a spray system of spraying a processing liquid, a web system of bringing a light-sensitive material into contact with a carrrying member impregnated with a processing liquid, or a developing system using a viscous processing liquid. However, a series of the processing steps substantially comprises the three steps, i.e., a colour developing step, a bleach-fixing step and a washing or the alternative stabilizing step.

The bleach-fixing step may be separated into a bleaching step and a fixing step or may be carried out in a bleach-fixing bath in which both of the bleaching and fixing are carried out in a single bath.

Bleaching agents which may be used in the bleach-fixer used in the invention are the metal complex salts of organic acids. Such complex salts include an aminopolycarboxylic acid, or those coordinated the metal ions of cobalt, copper or the like with such an organic acid as oxalic acid, citric acid or the like. The most preferable example of the organic acids used to produce the metal complex salts of such an organic acid as mentioned above is a polycarboxylic acid. These poly-carboxylic acids or aminopolycarboxylic acids are allowed to be the alkali-metal salts, ammonium salts or water-soluble amine salts thereof. The typical examples thereof may be given as follows.

[1] Ethylenediaminetetraacetic acid,

[2] Diethylenetriaminepentaacetic acid,

[3] Ethylenediamine-N-(β-oxyethyl)-N,N',N'-triacetic acid,

[4] Propylenediaminetetraacetic acid,

[5] Nitrilotriacetic acid,

[6] Cyclohexanediaminetetraacetic acid,

[7] Iminodiacetic acid,

[8] Dihydroxyethylglycine citric (or tartaric) acid,

[9] Ethyletherdiaminetetraacetic acid,

[10] Glycoletherdiaminetetraacetic acid,

[11] Ethylenedlaminetetrapropionic acid,

[12] Phenylenediaminetetraacetic acid,

[13] Disodium ethylenediaminetetraacetate,

[14] Tetra(Tri)methylammonium ethylenediaminetetraacetate,

[15] Tetrasodium ethylenediaminetetraacetate,

[16] Pentasodium diethylenetriaminepentaacetate,

[17] Sodium ethylenediamine-N-(β-oxyethyl)-N,N',N'-triacetate,

[18] Sodium propylenediaminetetraacetate,

[19] Sodium nitriloacetate,

[20] Sodium cyclohexanediaminetetraacetate.

These bleaching agents are used in an amount of from 5 to 450 g per liter and, more preferably, from 20 to 250 g per liter. A bleach-fixer contains, besides such a bleaching agent as mentioned above, a silver halide fixing agent and, if required, a preservative that is a liquid containing a sulfite. It is also allowed to use a bleach-fixer comprising an iron (III) ethylenediaminetetraacetate bleaching agent and a small amount of such a halide as ammonium bromide that is other than the above-mentioned silver halide fixing agent; a bleach-fixer comprising, on the contrary to the above, a large amount of such a halide as ammonium bromide; and a peculiar bleach-fixer comprising the combination of an iron (III) ethylenediaminetetraacetate bleaching agent and a large amount of such a halide as ammonium bromide. Besides the ammonium bromide, the above-mentioned halides used for this purpose inclids, hydrochloric acid, hydrobromic acid, lithium bromide, sodium bromide, potassium bromide, sodium iodide, potassium iodide, ammonium iodide and so forth.

The above-mentioned silver halide fixing agents contained in the bleach-fixers include the compounds capable of producing a water-soluble complex salt upon reaction with silver halide such as those used in an ordinary fixing treatment. Such compounds are typically represented by thiosulfates such as potassium thiosulfate, sodium thiosulfate and ammonium thiosulfate; thiocyanates such as potassium thiocyanate, sodium thiocyanate and ammonium thiocyanate; thiourea; thioether; and so forth. These fixing agents are used in an amount within the range where they may be dissolved, that is, not less than 5 g per liter and generally from 70 g to 250 g per liter.

The bleach-fixers are also allowed to contain various types of pH buffers independently or in combination, such as boric acid, borax, sodium hydroxide, potassium hydroxide, sodium carbonate, potassium carbonate, sodium bicarbonate, potassium bicarbonate, acetic acid, sodium acetate, ammonium hydroxide and so forth. Further, they may also contain various types of optical brightening agents, defoaming agents or surface active agents. It is also allowed to contain suitably preservatives such as the bisulfurous acid addition products of hydroxylamine, hydrazinc or aldehyde compounds, and so forth; organic chelating agents such as aminopolycarboxylic acid, and so forth; stabilizers such as nitro alcohol, nitrates, and so forth; organic solvents such as methanol, dimethylsulfoamide, dimethylsulfoxide, and so forth; and the like.

The bleach-fixers used in the invention are allowed to contain various bleach accelerators such as those described in Japanese Patent O.P.I. Publication No. 280-1971; Japanese Patent Examined Publication Nos. 8506-1970 and 556-1971; Belgian Patent No. 770,910; Japanese Patent Examined Publication Nos. 8836-1970 and 9854-1978; Japanese Patent O.P.I. Publication Nos. 71634-1979 and 42349-1974; and so forth.

The bleach-fixers are used at a pH value of not lower than 4.0 and, generally, within the range of from not lower than pH 5.0 to not higher than pH 9.5. The processing temperature is not higher than 80° C. that is 3° C. or more lower than the temperature of a processing liquid used in a colour developing tank and preferably 5° C. or more lower than and, further desirably not higher than 55° C. so as to inhibit evaporation or the like.

In the method of the invention for processing silver halide colour photographic light-sensitive materials, the above-mentioned colour developing step carried out with a colour developer containing the compounds of the invention and the above-mentioned bleach-fixing step are followed by a washing or a stabilizing step substituting for the washing step.

The stabilizing step applicable to the invention, which substitutes for the washing step, will be described below.

In the stabilizers substituting for washing water, which may be applied to the invention, the pH value thereof is within the range of, preferably, from 5.5 to 10.0 and, more preferably, from pH 6.3 to 9.5 and, particularly, from pH 7.0 to 9.0. As for the pH adjusters which may be contained in the stabilizers substituting for washing water, which is applicable to the invention, any generally known alkalizers or acidifyers may be used.

The processing temperature in the stabilizing step is within the range of from 15° C. to 60° C. and preferably from 20° C. to 45° C. From the viewpoint of rapid processing, the processing time is the shorter, the better. However, it is usually from 20 seconds to 10 minutes and most preferably from 1 minute to 3 minutes. In the case of a multi-tank stabilizing step, it is preferred that the processing time may be more shorter in a preceding tank, while it may be more longer in a successive tank. It is particularly desirable that the processing time in each tank should be 20% to 50% longer than in the preceding tank, respectively. After the stabilizing step applicable to the invention, none of any washing step is needed at all. It is, however, allowed to carry out a rinse, a surface cleaning and so on with a small amount of water for a very short time, if required.

When using a multi-tank counter current system, a preferable method of supplying a stabilizer substituting for washing water to a stabilizing step applicable to the invention is to supply it to a successive bath and then to overflow from a preceding bath. It is the matter of course that a processing may also be made in a single tank. As for the methods of adding the aforementioned compounds, there are various methods including, for example, a method in which a concentrated liquid is added into a stabilizing tank, another method in which the aforementioned compounds and other additives are added into the stabilizer substituting for washing water to be supplied to a stabilizing tank so as to make a supply liquid to the replenisher for the stabilizer substituting for washing water. The addition thereof may be made in any methods.

As mentioned above, in the invention, a 'processing made with a stabilizer' means a stabilizing processing in which, after processing with a bleach-fixer, a stabilizing process is immediately carried out without any washing process substantially. The processing liquid used in the above-mentioned stabilizing process is called a 'stabilizer substituting for washing water'. The processing tank is called a 'stabilizing bath' or a 'stabilizing tank'.

In the stabilizing processes applicable to the invention, the advantages of the invention may effectively be displayed when the stabilizing tank system is composed of one to five tanks and, at the very most, not more than nine tanks.

In the methods of processing the silver halide colour photographic light-sensitive materials of the invention, the compounds of the invention represented by the foregoing Formula [I] are used as a preservative to be contained in the aforementioned colour developers and the silver halides of at least one silver halide emulsion layer of the silver halide colour photographic light-sensitive material are substantially composed of silver chlorobromide grains each having a silver chloride content of not less than 20 mol %.

The expression of '——— be substantially composed of silver chloride' mentioned herein means that '——— be allowed to contain a small amount of silver iodide grains, besides the silver chlorobromide grains'. For example, it means that the silver chlorobromide grains which are allowed to contain silver iodide grains in an amount of not more than 0.3 mol % and, more preferably, not more than 0.1 mol %. However, in the invention, silver chlorobromide grains not containing any silver iodide grain are most preferable.

In the invention, at least one silver halide emulsion layer may be satisfactorily be used, provided that the silver chloride content thereof is not less than 20 mol %, preferably not lees than 30 mol %, more preferably not less than 60 mol % and preferably in particular not less than 80 mol %. For example, it will do if the above-mentioned requirement may be satisfied either by everyone of a blue-sensitive layer, a green-sensitive layer and a red-sensitive layer or by only one layer. However, it is preferable that the requirement is satisfied by at least one of the green-sensitive layer and the red-sensitive layer and it is more preferable that the above-mentioned requirement is staisfied by the blue-, green- and red-sensitive layers for the viewpoint of the rapid processing.

In the invention, the crystals of silver halide grains which are substantially silver chlorobromide may be of the normal, twinned or the others. The ratios of [100] plane to [111] plane may freely be selected. Further, the crystal structures of the silver halide grains may be uniform from the inside through the outside of each grain or may be layer-like from the inside through the outside both heterogeneous from each other, (that is called a core/shell type). In addition, these silver halide grains may be of such a type that a latent image may be formed mainly on the surface of the grains or may be of such a type that a latent image may be formed inside the grains. Further, tabular silver halide grains may also be used. (See Japanese Patent O.P.I. Publication No. 113934-1983 and Japanese Patent Application No. 170070–1984).

From the viewpoint of improving the stability of dye images, the particularly preferable silver halide grains used in the invention include those of the substantially mono-disperse type and, further, the core/shell type grains.

Monodisper silver halide grains preferably used in the invention are those in which, when observing the emulsion thereof with an electron micrograph, each of the silver halide grains seems to be uniform in both shape and size and each of the grains has the ratio $S/\bar{r}$ of the standard deviation S of the grain size distribution to the average grain size $\bar{r}$ of, preferably, not more than 0.22 and, more preferably, not more than 0.15. Wherein, Standard deviation S of a grain size distribution may be obtained by the following equation:

$$(s) = \sqrt{\frac{\Sigma (r - ri)^2 ni}{\Sigma ni}}$$

In the case of globular-shaped silver halide grains, an average grain size $\bar{r}$ mentioned herein is an average diameter of the grains. In the case of cubic grains or other shaped grains than the globular grains, it is an average diameter obtained when the projected image thereof is converted into a circular image having the same area, and, in the case that the grain size of individual grain is ri and the number of the grains is ni, $\bar{r}$ is defined by the following equation:

$$r = \frac{\Sigma niri}{\Sigma ni}$$

The above-mentioned grain sizes can be measured in various methods generally used in the fields of the art for the above-mentioned purpose. The typical methods are described in, for example. Loveland, "A Chart of Grain Size Analyses", A.S.T.M. Symposium on Light Microscopy, 1955, pp. 94 to 122; or Mess and James, "The Theory of the Photographic Process", 3rd Ed., The Macmillan Co., 1966. Chap. 2. These grain sizes may be measured by making use of the projective areas of grains or an approximate value of each diameter. When grains are substantially uniform in shape, the accurate grain size distribution may considerably be expressed in terms of the diameter or the projective area thereof.

The relation of the grain size distribution ma be determined in the method described in Trivelli and Smith, 'The Experimental Relationship Between Sensitometric Distribution and Grain Size Distribution in Photographic Emulsions', The Photographic Journal, Vol. LXXIX, (1946), pp. 330 to 338.

The silver halide grains used in the silver halide emulsions of the invention may be prepared in any one of an acid process, a neutral process and an ammonia process.

It is also allowed to use, for example, a process in which seed grains are prepared in an acid process and are then further grown in an ammonia process having a relatively faster growing rate, so that the grains can be grown up to a desired size. In the case of growing silver halide grains, it is preferred to controll pH, a pAg and so forth in a reaction furnace and then to pour and mix silver ions and halide ions gradually and simultaneously both in an amount corresponding to the growth rate of silver halide grains, such as described in Japanese Patent O.P.I. Publication No. 48521-1979.

The silver halide grains relating to the invention are preferably prepared in such a manner as described above. The composition containing the above-mentioned silver halide grains is called a silver halide emulsion in this specification.

The above-mentioned silver halide emulsions may be chemically sensitized with various sensitizers, for example, an active gelatin; sulfur sensitizers including allylthiocarbamide, thiourea, cystins and so forth; selenium sensitizers; reduction sensitizers including a stannous salt, thiourea dioxide, a polyamine and so forth; noble-metal sensitizers including gold sensitizers such as, typically, potassium aurithiocyanate, potassium chloroaurate, 2-aurothio-3-methylbenzothiazolium chloride and so forth, or sensitizers of the water-soluble salts of ruthenium, palladium, platinum, rhodium, iridium and so forth such typically, ammonium chloropalladate, potassium chloroplatinate, sodium chloropalladate (some kinds of which work as the sensitizers, anti-fogging agents or the like according to the amounts added). These sensitizers may be used independently or in suitable combination. (For example, a combination use of a gold sensitizer and a sufur sensitizer, a gold sensitizer and a selenium sensitizer, or other combinations).

The silver halide emulsions relating to the invention may be chemically sensitized after adding a sulfur-containing compound and are also allowed to contain at least one kind of nitrogen-containing heterocyclic compounds each having at least one kind of hydroxyzaindenes and mercapto groups, upon, before, during or after applying the chemical ripening.

For the purpose of endowing each of desired spectral wavelength regions with the respective photosensitivities, the silver halides used in the invention may be optically sensitized by adding a suitable spectral sensitizing dye in an amount of from $5\times10^{-8}$ to $3\times10^{-3}$ to mol of the silver halides. Various types of the spectral sensitizing dyes may be used independently or in combination. Those advantageously used in the invention include, for example, the following dyes.

Namely, the spectral sensitizing dyes used in blue-sensitive silver halide emulsions include those described for example, West German Patent Nos. 929,080; U.S. Pat. Nos. 2,231,658, 2,493,748, 2,503,776, 2,519,001, 2,912,329, 3,656,959, 3,672,897, 3,694,217, 4,025,349 and 4,046,572; British Patent No. 1,242,588; Japanese Patent Examined Publication Nos. 14030-1969 and 24844-1977; and the like. The spectral sensitizing dyes used in green-sensitive silver halide emulsions typically include a cyanine dye, a merocyanine dye or a compositer cyanine dye such as those described in, for example, U.S. Pat. Nos. 1,939,201, 2,072,908, 2,739,149 and 2,945,763; British Patent No. 505,979; and the like. The spectral sensitizing dyes used in red-sensitive silver halide emulsions typically include a cyanine dye, a merocyanine dye or a composite cyanine dye such as those described in, for example, U.S. Pat. Nos. 2,269,234, 2,270,378, 2,442,710, 2,454,629 and 2,776,280; and the like. Besides the above, the cyanine dyes, merocyanine dyes or the composite cyanine dyes such as those described in U.S. Pat. Nos. 2,213,995, 2,493,748 and 2,519,001; West German Patent No. 929,080; and the like, may also be used advantageously in green- or red-sensitive silver halide emulsions.

These spectral sensitizing dyes may be used independently or in combination.

If required, the photographic light-sensitive materials, of the invention may be optically sensitized to desired wavelength regions in a spectral sensitizing process using cyanine dyes or merocyanine dyes independently or in combination.

The particularly preferable spectral sensitizing processes include, for example, those described in Japanese Patent Examined Publication Nos. 4936-1968, 22884-1968, 18433-1970, 37443-1972, 28293-1973, 6209-1974 and 12375-1978; Japanese Patent O.P.I. Publication Nos. 23931-1977, 51932-1977, 80118-1979, 153926-1983, 116646-1984 and 116647-1984; and so forth, which are concerning the combination of benzimidazolocarbocyanine and benzooxazolocarbocyanine.

The descriptions of the combination of carbocyanines having benzimidazole nuclei and other syanines or merocyanines are found in, for example, Japanese Patent Examined Publication Nos. 25831-1970, 11114-1972, 25379-1972, 38406-1973, 38407-1973, 34535-1979 and 1569-1980; Japanese Patent O.P.I. Publication Nos. 33220-1975, 107127-1976, 115820-1976, 135528-1976, 104916-1977 and 104917-1977; and so forth.

The descriptions of the combination of benzooxazolocarbocyanine (i.e., oxa.carbocyanine) and other carbocyanines are found in, for example, Japanese Patent Examined Publication Nos. 32753-1969 and 11627-1971:and Japanese Patent O.P.I. Publication No. 1483-1982. The descriptions of merocyanines are found in, for example, Japanese Patent Examined Publication Nos. 38408-1973, 41204-1973 and 40662-1975; Japanese Patent O.P.I. Publication Nos. 25728-1981, 10753-1983, 91445-1983, 116645-1984 and 33828-1975; and so forth.

The descriptions of the combination of thiacarbocyantne and other carbocyanines are found in, for example, Japanese Patent Examined Publication Nos, 4932-1968, 4933-1968, 26470-1970, 18107-1971 and 8741-1972; Japanese Patent O.P.I. Publication No. 114533-1984; and so forth. It may also be advantageous to use the process described in Japanese Patent Examined Publication No. 6207-1974, in which zeromethine- or dimethine-merocyanine, monomethine- or trimethine-cyanine and a styryl dye are used.

Before these spectral sensitizing dyes are added into a silver halide emulsion relating to the invention, they are dissolved in advance in a hydrophilic organic solvents such as methyl alcohol, ethyl alcohol, acetone, dimethyl formamide, fluoroalcohol such as those described in Japanese Patent Examined Publication No. 40659-1975 and so forth, so as to be a dye solution and then used.

The spectral sensitizing dye solution may be added at any point of time, for example, at the beginning of, during or after chemically ripening a silver halide emulsion. The solution may also be added in the step immediately before an emulsion coating step, if occasion demands, A dye which is soluble by water or decolourizable by a colour developer, (i.e., an AI dyestuff), may be added in the photographic component layers of the silver halide colour photographic light-sensitive materials of the invention. The AI dyes include, for example, an oxanol dyestuff, a hemioxanol dyestuff, a merocyanine dyestuf, and an azo dyestuff. Among these dyestuffs, the oxanol dyestuffs, hemioxanol dyestuffs, merocyanine dyestuffs and so forth are useful. The examples of the usable AI dyestuffs include those described in British Patent Nos. 584,609 and 1,227,429; Japanese Patent O.P.I. Publication Nos. 85130-1973, 99620-1974, 114420-1974, 129537-1974, 108115-1977, 25845-1984, 11640-1984 and 111641-1984; and U.S. Pat. Nos. 2,274,782, 2,333,472, 2,956,879, 3,123,448, 3,148,187, 3,177,078, 3,247,127, 3,260,601, 3,540,887, 3,575,704, 3,653,905, 3,718,472, 4,071,312 and 4,071,352.

These AI dyestuffs are generally used in an amount of, preferably, from $2\times10^{-3}$ to $3\times10^{-1}$ mol per mol of silver contained in an emulsion layer and, more preferably, from $1\times10^{-2}$ to $1\times10^{-1}$ mol.

The silver halide emulsion layers relating to the invention may be able to contain couplers, respectively. Namely, the compounds capable of producing a dye upon reaction with the oxidized products of a colour developing agent.

As for the above-mentioned couplers which may be used in the invention, various types of yellow couplers, magenta couplers and cyan couplers may be used without any special limitation. These couplers may be either of the so-called two-equivalent type or four-equivalent type. It is also allowed to combine these couplers with a diffusive dye-releasing type couplers and so forth.

The effective yellow couplers among the above-mentioned yellow couplers include, for example, an open-chained ketomethylene compound and, further, the so-called two-equivalent type couplers such as an active site-0-aryl-substituted coupler, an active site-0-acyl-substituted coupler, an active site-hydantoine compound-substituted coupler, an active site-0-urazol compound-substituted coupler and an active site-succinimide compound-substituted coupler, an active-site-fluorine-substituted coupler, an active site-chlorine or bromine-substituted coupler, an active site-0-sulfonyl-substituted coupler and so forth. The typical examples of such usable yellow couplers include those described in U.S. Pat. Nos. 2,875,057, 3,265,506, 3,408,194, 3,551,155, 3,582,322, 3,725,072 and 3,891,445; West German Patent No. 1,547,868; West German Patent OLS No. 2,219,917, 2,261,361 and 2,414,006; British Patent No. 1,425,020; Japanese Patent Examined Publication No. 10783-1976; Japanese Patent O.P.I. Publication Nos. 26133-1972, 73147-1973, 102636-1976, 6341-1975, 123342-1975, 130442-1975, 21827-1976, 87650-1975, 82424-1977, 115219-1977 and 95346-1983; and so forth.

The magenta couplers used in the invention include, for example, the compounds of a pyrazolone type, a pyrazolotriazole type, a pyrazolinobenzimidazole type and an indazolone type. These magenta couplers may be not only four-equivalent type couplers, but also two-equivalent type couplers, similar to the case of the yellow couplers. The typical examples of the magenta couplers include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445; West German Patent No. 1,810,464; West German Patent OLS No. 2,408,665, 2,417,945, 2,418,959 and 2,424,467; Japanese Patent Examined Publication No. 6031-1966; Japanese Patent O.P.I. Publication Nos. 20826-1976, 58922-1977, 129538-1974, 74027-1974, 159336-1975, 42121-1977, 74028-1974, 60233-1975, 26541-1976 and 55122-1978; Japanese Patent Application No. 110943-1980; and so forth.

The useful cyan couplers used in the invention include, for example, those of the phenol type, the naphthol type and so forth. These cyan couplers may be not only four-equivalent type couplers, but also two-equivalent type couplers, similar to the case of the yellow couplers. The typical examples of the cyan couplers include those described in U.S. Pat. Nos. 2,369,929, 2,434,272, 2,474,293, 2,521,908, 2,895,826, 3,034,892. 3,311,476, 3,458,315, 3,476,563, 3,583,971, 3,591,388, 3,767,411, 3,772,002, 3,933,494 and 4,004,929; West German Patent OLS No. 2,414,830 and 2,454,329; Japanese Patent O.P.I. Publication Nos. 59838-1973, 26034-1976, 5055-1973, 146827-1976, 69624-1977, 90932-1977 and 95346-1983; Japanese Patent Examined Publication No. 11572-1974; and so forth.

In the silver halide emulsion layers and other photographic component layers of the invention, it is allowed to use the couplers in combination, such as a non-diffusive DIR compound, a coloured magenta- or cyan-coupler, a polymer coupler, a diffusive DIR compounds and so forth. The non-diffusive DIR compounds and the coloured magenta- or cyan-couplers may be referred to the description of Japanese Patent Application No. 193611-1984 applied by the present patent applicant, and the polymer couplers may be referred to the description of Japanese Patent O.P.I. Publication No. 72235-1986 applied by the present patent applicant.

How to add the above-mentioned couplers which can be used in the invention into the photographic component layers of the invention may be the same as in the conventional methods. The amounts of the couplers to be added are not limitative, but are preferably $1\times^{-3}$ to 5 mol per mol of the silver used and more preferably from $1\times10^{-2}$ to $5\times10^{-1}$ mol.

The silver halide colour photographic light-sensitive materials of the invention are also allowed to contain a variety of photographic additives in addition the the above-mentioned couplers. For example, these additves include an antifogging agent, a stabilizer, a UV absorbing agent, an anti-colour staining agent, an optical brightening agent, a colour image antifading agent, an antistatic agent, a hardening agent, a surface active agent, a plasticizing agent, a wetting agent and so forth each described in Research Disclosure, No. 17643.

In the silver halide colour photographic light-sensitive materials of the invention, the hydrophilic colloids used to prepare emulsions include any colloids, for example, gelatins, graft polymers of gelatin and other macromolecules, proteins such as albumin, casein and so forth, cellulose derivatives such as a hydroxyethylcellulose derivative, a carboxymethylcellulose and so forth, starch derivatives, synthetic hydrophilic macromolecules of a monomer or copolymer, such as polyvinyl alcohol, polyvinyl imidazole, polyacryl amide and so forth.

As for the supports of the silver halide colour photographic light-sensitive materials of the invention, there may be given as the examples, a baryta paper, a polyethylene-coated paper, a synthetic polypropylene paper, a transparent support provided together with a reflection layer or using together with a reflector member including, for example, glass plates, polyester films such as those of cellulose acetate, cellulose nitrate or polyethyleneterephthalate, polyamide films, polycarbonate films, polystyrene films and so forth. Besides the above, othe ordinary transparent supports may also be used. These supports are suitably selected to use according to the purposes of light-sensitive materials.

When coating the silver halide emulsion layers and the other photographic component layers each used in the invention, a variety of coating methods such as a dip-coating method, an air-doctor coating method, a curtain coating method, a hopper coating method and so forth may be applied. It is also allowed to apply a simultaneous multilayer coating method for coating two or more layers at the same time, such as the methods described in U.S. Pat. Nos. 2.761,791 and 2,941,898.

In the invention, any positioning arrangement of each emulsion layer may be freely determined when coating the layers. In the case of a full-colour light-sensitive print paper, for example, it is preferred to arrange a blue-sensitive silver halide emulsion layer, a green-sensitive silver halide emulsion layer and a red-sensitive silver halide emulsion layer in order from a support side. Each of these light-sensitive silver halide emulsion layers is allowed to comprise two or more element layers.

In accordance with the purposes of the light-sensitive materials of the invention, it is arbitrary to provide interlayers having a suitable thickness to the light-sensitive materials. In addition, a variety of layers such as a filter layer, a non-curling layer, a protective layer, an antihalation layer and so forth may suitably be used in combination so as to serve as the component layers. These component layers are allowed to contain hydrophilic colloids as the binding agent, similar to the case of such an emulsion layer as mentioned before. The component layers are also allowed to contain various photographic additives which may be added into such an emulsion layer as mentioned before.

Applicability of the Invention to Industrial Fields

As described above, the invention has been able to provide a method of processing a silver halide colour photographic light-sensitive material, in which a colour developer can be kept excellent in stability of long standing and, particularly, a satisfactory maximum colour density can be obtained without deteriorating photographic characteristics by fog and the like and, further, a rapid processing can be performed.

Now, the invention will be described in more detail with referring to the following examples. It is, however, to be understood that the embodiments of the invention shall not be limited thereto.

EXAMPLE 1

A Silver halide colour photographic light-sensitive material (hereinafter called Sample A of the Invention) was prepared by coating the following eight layers onto a polyethylene-laminated paper support. Every amount added stated herein indicates an amount added per square meter, unless otherwise specially stated, Layer 1 . . . A layer containing 1.0 g of gelatin.

Layer 2 . . . A layer containing 1.2 g of gelatin, 0.4 g (in terms of silver content) of a blue-sensitive silver chlorobromide emulsion (Silver bromide content: 90 mol %, Average grain size: 0.7 μm), and 0.80 g of yellow coupler (Y-1) indicated below which were dissolved in 0.5 g of dioctyl phthalate.

Layer 3 . . . A layer (Interlayer) containing 0.7 g of gelatin.

Layer 4 . . . A layer containing 0.7 g of gelatin, 0.4 g of a green-sensitive silver chlorobromide emulsion (Silver halide composition shown in Table 1, Average grain size: 0.5 μm ) and 0.63 g of magenta coupler (M-1) indicated below which were dissolved in 0.3 g of dioctyl phthalate.

Layer 5 . . . A layer (Interlayer) containing 1.2 g of gelatin.

Layer 6 . . . A layer containing 1.4 g of gelatin, 0.31 g of a red-sensitive silver chlorobromide emulsion (Silver halide composition shown in Table 1, Average grain size: 0.4 μm) and 0.45 g of cyan coupler (C-1) indicated below which were dissolved in 0.2 g of dioctyl phthalate, Layer 7 . . . A layer containing 1.0 g of gelatin and 0.30 g of Tinuvin 328 (manufactured by Ciba Geigy AG) which were dissolved in 0.2 g of dioctyl phthalate.

Layer 8 . . . A layer containing 0.5 g of gelatin.

Yellow coupler (Y-1)

-continued

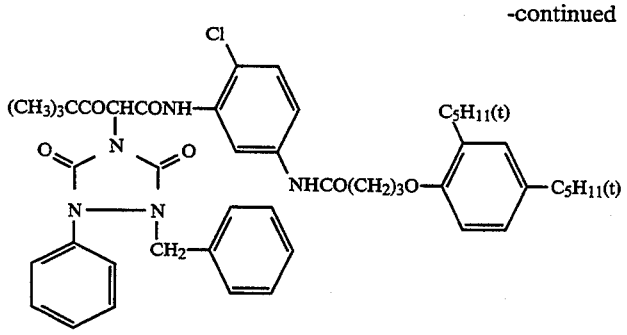

Magenta coupler (M-1)

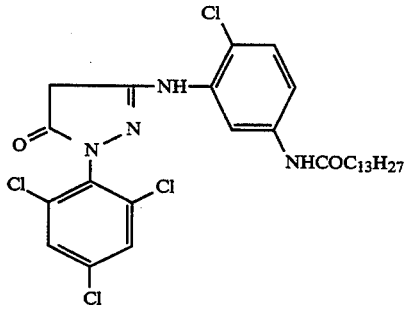

Cyan coupler (C-1)

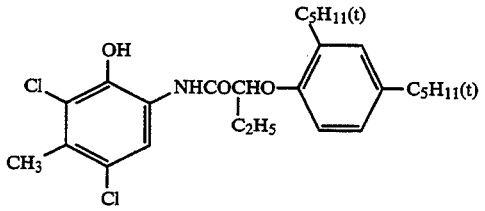

As a hardening agent, bis (vinyl sulfonylmethyl) ether was added in an amount of 0.015 g per g of gelatin into each of the above-mentioned layers 1, 3, 5 and 8, respectively.

Each of the light-sensitive materials shown in Table 1 was exposed to light through an optical wedge and was then processed in the following steps.

| Processing steps (at 35° C.) | |
|---|---|
| Colour developing | |
| Bleach-fixing | 50 seconds |
| Stabilizing | 50 seconds |
| Drying | 60 seconds (at 60 to 80° C.) |

The composition of each processing liquid was as follows:

| [Colour developer] | |
|---|---|
| Pure water | 800 ml |
| Preservative shown in Table 1 | Amount shown in Table 1 |
| Potassium bromide | 0.8 g |
| Sodium chloride | 1.0 g |
| Potassium sulfite | 2.0 g |
| Triethanol amine | 2.0 g |
| Exemplified colour developing agent (1) | 6.0 g |
| 1-hydroxyethylidene-1,1'-diphosphonic acid (a 60% aqueous solution) | 1.5 ml |
| Magnesium chloride | 50 g |
| Kaycoll-PK-Conc (an optical brightening agent, manufactured by Shin Nisso Chemical Co.) | 2 ml |
| Pure water to make | 1 liter |
| pH to be adjusted with a 20% potassium hydroxide solution or a 10% dillute sulfuric acid solution to | pH =11.5 |
| [Bleach-Fixer] | |
| Pure water | 500 ml |
| Iron (III) ammonium ethylenediaminetetra-acetate | 65 g |
| Ammonium thiosulfite (a 70% aqueous solution) | 85 g |
| Sodium hydrogensulfite | 10 g |
| Sodium metabisulfite | 2 g |
| Disodium ethylenediaminetetraacetate | 20 g |
| Pure water to make | 1 liter |
| pH to be adjusted with aqueous ammonia or dillute sulfuric acid to | pH = 7.0 |
| [Stabilizer] | |
| 5-chloro-2-methyl-4-isothiazoline-3-one | 0.03 g |
| Orthophenylphenol | 0.02 g |
| 2-methyl-4-isothiazoline-3-one | 0.03 g |
| 1-hydroxyethylidene-1,1-diphosphonic acid | 0.5 g |
| Magnesium nitrate | 0.04 g |
| Zinc sulfate | 0.5 g |
| Aqueous ammonia (a 28% aqueous solution) | 2 g |
| Water to make | 1 liter |
| pH to be adjusted with sulfuric acid and potassium hydroxide to | pH = 7.8 |

The maximum colour reflection density of the yellow dye obtained when the colour development was made at 35° C. and for minutes was meadured by means of an optical densitometer Model PDA-65 (manufactured by Konishiroku Photo Ind. Co., Ltd.) and the obtained value was regarded as 100. A processing time necessary for making the above-mentioned maximum colour reflection density of yellow dye be 80 (that is called a development convergence time) was obtained and shown in Table 1. This development convergence time is a time for developing a blue-sensitive emulsion layer having the most slowest rate of development, therefore, this time indicates the time for completing the development of a light-sensitive material. Table 1 also shows the respective maximum colour reflection densities of yellow, magenta and cyan dyes obtained when processing a light-sensitive material for the above-mentioned development convergence time.

TABLE 1

| Experiment No. | Green-sensitive layer, AgBr cont. (mol %) | Red-sensitive layer, AgBr cont. (mol %) | Preservative (Amt. added) | Dev. convergent time (sec) | Maximum dye density Yellow | Magenta | Cyan |
|---|---|---|---|---|---|---|---|
| 1 (Comp.) | 85 | 85 | Hydroxylamine | 182 | 2.48 | 2.81 | 2.76 |
| 2 (Comp.) | 85 | 80 | sulfate | 161 | 2.48 | 2.80 | 2.51 |
| 3 (Comp.) | 85 | 75 | (2 g/liter) | 158 | 2.47 | 2.80 | 2.49 |
| 4 (Comp.) | 80 | 70 | | 139 | 2.46 | 2.79 | 2.23 |
| 5 (Comp.) | 85 | 65 | | 135 | 2.45 | 2.79 | 2.20 |
| 6 (Comp.) | 85 | 60 | | 115 | 2.43 | 2.79 | 1.97 |
| 7 (Comp.) | 85 | 55 | | 113 | 2.42 | 2.78 | 1.94 |
| 8 (Comp.) | 85 | 50 | | 92 | 2.42 | 2.78 | 1.69 |
| 9 (Comp.) | 80 | 80 | | 142 | 2.46 | 2.52 | 2.49 |
| 10 (Comp.) | 75 | 75 | | 140 | 2.46 | 2.49 | 2.47 |
| 11 (Comp.) | 70 | 70 | | 117 | 2.43 | 2.22 | 2.19 |
| 12 (Comp.) | 65 | 65 | | 115 | 2.41 | 2.18 | 2.18 |
| 13 (Comp.) | 60 | 60 | | 91 | 2.40 | 1.93 | 1.95 |
| 14 (Comp.) | 55 | 55 | | 89 | 2.39 | 1.91 | 1.92 |
| 15 (Comp.) | 50 | 50 | | 64 | 2.37 | 1.62 | 1.64 |
| 16 (Comp.) | 40 | 40 | | 60 | 2.35 | 1.48 | 1.51 |
| 17 (Comp.) | 30 | 30 | | 53 | 2.33 | 1.41 | 1.43 |
| 18 (Comp.) | 20 | 20 | | 48 | 2.30 | 1.32 | 1.33 |
| 19 (Comp.) | 10 | 10 | | 45 | 2.28 | 1.20 | 1.22 |
| 20 (Comp.) | 1.0 | 1.0 | | 39 | 2.27 | 1.13 | 1.15 |
| 21 (Comp.) | 0.5 | 0.5 | | 35 | 2.25 | 1.09 | 1.08 |
| 22 (Comp.) | 85 | 85 | Exemplified | 179 | 2.51 | 2.83 | 2.79 |
| 23 (Inv.) | 85 | 80 | compound (3) | 160 | 2.51 | 2.82 | 2.79 |
| 24 (Inv.) | 85 | 75 | (2 g/liter) | 159 | 2.51 | 2.82 | 2.78 |
| 25 (Inv.) | 85 | 70 | | 137 | 2.50 | 2.81 | 2.78 |
| 26 (Inv.) | 85 | 65 | | 136 | 2.50 | 2.81 | 2.78 |
| 27 (Inv.) | 85 | 60 | | 113 | 2.50 | 2.81 | 2.77 |
| 28 (Inv.) | 85 | 55 | | 112 | 2.50 | 2.81 | 2.77 |
| 29 (Inv.) | 85 | 50 | | 90 | 2.50 | 2.81 | 2.77 |
| 30 (Inv.) | 80 | 80 | | 140 | 2.52 | 2.82 | 2.78 |
| 31 (Inv.) | 75 | 75 | | 139 | 2.52 | 2.82 | 2.78 |
| 32 (Inv.) | 70 | 70 | | 116 | 2.51 | 2.81 | 2.77 |
| 33 (Inv.) | 65 | 65 | Exemplified | 114 | 2.50 | 2.81 | 2.77 |
| 34 (Inv.) | 60 | 60 | compound (3) | 89 | 2.50 | 2.81 | 2.76 |
| 35 (Inv.) | 55 | 55 | (2 g/liter) | 87 | 2.49 | 2.80 | 2.76 |
| 36 (Inv.) | 50 | 50 | | 65 | 2.49 | 2.80 | 2.76 |
| 37 (Inv.) | 40 | 40 | | 62 | 2.49 | 2.80 | 2.75 |
| 38 (Inv.) | 30 | 30 | | 55 | 2.49 | 2.80 | 2.74 |
| 39 (Inv.) | 20 | 20 | | 50 | 2.48 | 2.79 | 2.74 |
| 40 (Inv.) | 10 | 10 | | 44 | 2.47 | 2.79 | 2.74 |
| 41 (Inv.) | 1.0 | 1.0 | | 41 | 2.47 | 2.79 | 2.74 |
| 42 (Inv.) | 0.5 | 0.5 | | 30 | 2.45 | 2.79 | 2.73 |
| 43 (Inv.) | 50 | 50 | Exemplified | 62 | 2.50 | 2.81 | 2.77 |
| 44 (Inv.) | 20 | 20 | compound (22) | 49 | 2.50 | 2.80 | 2.76 |
| 45 (Inv.) | 0.5 | 0.5 | (2 g/liter) | 31 | 2.49 | 2.80 | 2.75 |
| 46 (Inv.) | 50 | 50 | Exemplified | 60 | 2.48 | 2.80 | 2.76 |
| 47 (Inv.) | 20 | 20 | compound (25) | 50 | 2.47 | 2.78 | 2.74 |
| 48 (Inv.) | 0.5 | 0.5 | (2 g/liter) | 30 | 2.47 | 2.77 | 2.73 |
| 49 (Inv.) | 50 | 50 | Exemplified | 61 | 2.47 | 2.78 | 2.75 |
| 50 (Inv.) | 20 | 20 | compound (27) | 51 | 2.45 | 2.78 | 2.74 |
| 51 (Inv.) | 0.5 | 0.5 | (2 g/liter) | 32 | 2.45 | 2.76 | 2.72 |

As is obvious from Table 1, it was found that, in the case of using a developer containing hydroxylamine sulfate that has so far been used as a preservative and reducing the silver bromide contents of a green-sensitive emulsion layer or a green-sensitive emulsion layer and a red-sensitive emulsion layer, the maximum color densities of the layers having the reduced silver bromide contents were lowered, while the development convergence time thereof were shortened, and that, when the preservative of the invention was used, no maximum color densities was lowered and the rapid processing thereof were performable.

EXAMPLE 2

The samples were prepared in such a manner that, the silver bromide contents of the blue-, green- and red-sensitive silver chlorobromide emulsions of the silver halide colour photographic light-sensitive material (Sample A) used in Example 1. such silver bromide contents thereof were changed, respectively, as shown in Table 3. The resulted samples were processed in the same manner as in Example 1, except that the developer composition was changed to that shown below and the colour developments were made for 45 seconds, provided therein that the preservatives were changed as shown in Table 2.

The respective maximum colour densities of the yellow, magenta and cyan dyes were measured in the same manner as in Example 1 and the results thereof are shown in Table 2.

| [Colour developer] | |
|---|---|
| Pure water | 800 ml |
| Preservative shown in Table 2 | Amount shown in Table 2 |
| Sodium chloride | 1.0 g |
| Potassium sulfite | 0.8 g |
| Sodium tetrapolyphosphate | 2.0 g |
| Potassium carbonate | 20 g |
| Exemplified colour developing agent (1) | 6.0 g |
| Water to make | 1 liter |
| pH to be adjusted with potassium hydroxide or a 10% aqueous dillute acetic acid solution to | pH = 10.10 |

TABLE 2

| Experiment No. | Blue-sensitive layer, AgBr cont. (mol %) | Green-sensitive layer, AgBr cont. (mol %) | Red-sensitive layer, AgBr cont. (mol %) | Preservative | Max. dye density Yellow | Magenta | Cyan |
|---|---|---|---|---|---|---|---|
| 52 | 40 | 40 | 40 | Hydroxylamine sulfate | 1.87 | 1.65 | 1.67 |
| 53 | 20 | 20 | 20 | 2.0 g/liter) | 1.76 | 1.52 | 1.55 |
| 54 | 10.0 | 10.0 | 10.0 | | 1.72 | 1.46 | 1.40 |
| 55 | 0.5 | 0.5 | 0.5 | | 1.65 | 1.34 | 1.32 |
| 56 | 40 | 40 | 40 | Exemplified compound | 1.99 | 2.01 | 2.03 |
| 57 | 20 | 20 | 20 | (3), 2.0 g/liter) | 2.12 | 2.21 | 2.20 |
| 58 | 10.0 | 10.0 | 10.0 | | 2.23 | 2.32 | 2.30 |
| 59 | 0.5 | 0.5 | 0.5 | | 2.47 | 2.73 | 2.75 |
| 60 | 40 | 40 | 40 | Exemplified compound | 1.96 | 1.99 | 2.00 |
| 61 | 20 | 20 | 20 | (22), 2.0 g/liter) | 2.09 | 2.16 | 2.16 |
| 62 | 10.0 | 10.0 | 10.0 | | 2.19 | 2.28 | 2.27 |
| 63 | 0.5 | 0.5 | 0.5 | | 2.46 | 2.72 | 2.73 |
| 64 | 40 | 40 | 40 | Exemplified compond | 1.98 | 1.99 | 2.03 |
| 65 | 20 | 20 | 20 | (25) | 2.11 | 2.20 | 2.21 |
| 66 | 10.0 | 10.0 | 10.0 | | 2.21 | 2.31 | 2.29 |
| 67 | 0.5 | 0.5 | 0.5 | | 2.47 | 2.72 | 2.74 |

As is obvious from Table 2, it was found that the comparative samples containing hydroxylamine were low in maximum colour density even if the silver halide composition of the silver halide photographic light-sensitive materials were changed and the maximum colour densities were gotten lowered as the silver chloride contents were increased and, on the other hand, Samples No. 56 through No. 67 using the preservatives of the invention were high in maximum colour density and, further, the lower the silver bromide contents are, the more the effect of using the preservative of the invention, that is the maximum colour density, can be displayed.

EXAMPLE 3

The same processing as in Example 1 was repeatedly applied to the samples prepared by changing the silver bromide contents to 45 mol % from those of the green- and red-sensitive silver chlorobromide emulsions of the light-sensitive materials used in Example 1, provided therein that the pH of the colour developer used was adjusted to 12 and the preservatives used were changed as shown in Table 3. In the same manners as in Example 1, each development convergence time and the respective maximum colour reflection densities of the yellow, magenta and cyan dyes were measured and the results thereof are shown in Table 3 below.

TABLE 3

| Experiment No. | Preservative, (g/liter) | Dev. convergent time, (sec) | Max. density of yellow dye | Max. density of magenta dye | Max. density of cyan dye |
|---|---|---|---|---|---|
| 68 (Comp.) | Hydroxylamine sulfate (1.5 g/liter) | 45 | 2.37 | 1.19 | 1.08 |
| 69 (Inv.) | Exemplified compound (1) (1.5 g/liter) | 46 | 2.48 | 2.76 | 2.69 |
| 70 (Inv.) | Exemplified compound (3) (1.5 g/liter) | 44 | 2.49 | 2.82 | 2.74 |
| 71 (Inv.) | Exemplified compound (6) (1.5 g/liter) | 45 | 2.48 | 2.74 | 2.71 |
| 72 (Inv.) | Exemplified compound (7) (1.5 g/liter) | 46 | 2.49 | 2.64 | 2.51 |
| 73 (Inv.) | Exemplified compound (8) (1.5 g/liter) | 45 | 2.50 | 2.65 | 2.53 |
| 74 (Inv.) | Exemplified compound (9) (1.5 g/liter) | 45 | 2.49 | 2.66 | 2.52 |
| 75 (Inv.) | Exemplified compound (13) (1.5 g/liter) | 46 | 2.48 | 2.77 | 2.72 |
| 76 (Inv.) | Hydrochloride of Exemplified compound (1) (1.5 g/liter) | 46 | 2.49 | 2.75 | 2.71 |
| 77 (Inv.) | Hydrochloride of Exemplified compound (3) (1.5 g/liter) | 43 | 2.50 | 2.81 | 2.73 |
| 78 (Inv.) | Hydrochloride of Exemplified compound (6) (1.5 g/liter) | 44 | 2.49 | 2.77 | 2.70 |

As is obvious from Table 3, it was found that, in the case of using the developer containing hydroxylamine sulfate having commonly been used as a preservative, the maximum colour densities were lowered in both of green- and red-sensitive emulsion layers each comprising a silver chlorobromide emulsion having a relatively lower silver bromide content and, on the other hand, when the preservative of the invention was used, the maximum colour density was not lowered and a rapid processing was performable.

EXAMPLE 4

As shown in Table 4, the silver bromide contents were changed from those of the green- and red-sensitive silver chlorobromide emulsions of the light-sensitive materials used in Example 1, and the same treatments as in Example 1 were repeatedly applied, provided therein that the pH values of the colour developers and the preservatives added were changed to as shown in Table 4, respectively.

Further, benzyl alcohol was added in an amount of 10 ml per liter into the colour developers and the concentration of the colour developing agents were changed to 4.5 g per liter, In the same manner as in Example 1, each development convergence time and the respective maximum colour reflection densities of the yellow, magenta and cyan dyes were measured and the results thereof are shown in Table 4.

TABLE 4

| Experiment No. | AgBr cont. (mol %) of green-sensitive layer | AgBr cont. (mol %) of red-sensitive layer | Preservative (amt. added) | pH of color developer | Dev. conv. time (sec.) | Max. density of yellow dye | Max. density of magenta dye | Max. density of cyan dye |
|---|---|---|---|---|---|---|---|---|
| 79 (Comp.) | 85 | 85 | Hydroxyl- | 10.2 | 191 | 2.52 | 2.83 | 2.77 |
| 80 (Comp.) | 85 | 85 | amine | 10.3 | 182 | 2.50 | 2.81 | 2.74 |
| 81 (Comp.) | 85 | 85 | sulfate, | 10.5 | 174 | 2.47 | 2.76 | 2.72 |
| 82 (Comp.) | 85 | 85 | (2.5 g/liter) | 10.7 | 162 | 2.46 | 2.73 | 2.68 |
| 83 (Comp.) | 85 | 85 | | 11.0 | 153 | 2.43 | 2.70 | 2.66 |
| 84 (Comp.) | 85 | 85 | | 12.0 | 141 | 2.40 | 2.68 | 2.65 |
| 85 (Comp.) | 80 | 80 | Hydroxyl- | 10.2 | 121 | 2.50 | 2.26 | 2.21 |
| 86 (Comp.) | 80 | 80 | amine | 10.3 | 103 | 2.49 | 1.91 | 1.89 |
| 87 (Comp.) | 80 | 80 | sulfate, | 10.5 | 100 | 2.47 | 1.89 | 1.86 |
| 88 (Comp.) | 80 | 80 | (2.5 g/liter) | 10.7 | 81 | 2.45 | 1.56 | 1.52 |
| 89 (Comp.) | 80 | 80 | | 11.0 | 76 | 2.41 | 1.53 | 1.50 |
| 90 (Comp.) | 80 | 80 | | 12.0 | 71 | 2.38 | 1.51 | 1.48 |
| 91 (Comp.) | 70 | 70 | Hydroxyl- | 10.2 | 103 | 2.49 | 1.93 | 1.87 |
| 92 (Comp.) | 70 | 70 | amine | 10.3 | 86 | 2.48 | 1.61 | 1.54 |
| 93 (Comp.) | 70 | 70 | sulfate, | 10.5 | 83 | 2.46 | 1.58 | 1.52 |
| 94 (Comp.) | 70 | 70 | (2.5 g/liter) | 10.7 | 64 | 2.43 | 1.28 | 1.24 |
| 95 (Comp.) | 70 | 70 | | 11.0 | 59 | 2.39 | 1.25 | 1.22 |
| 96 (Comp.) | 70 | 70 | | 12.0 | 53 | 2.36 | 1.23 | 1.20 |
| 97 (Inv.) | 60 | 60 | Sulfate of | 10.2 | 91 | 2.52 | 2.84 | 2.75 |
| 98 (Inv.) | 60 | 60 | Exemp. | 10.3 | 68 | 2.52 | 2.82 | 2.73 |
| 99 (Inv.) | 60 | 60 | compound (1) | 10.5 | 64 | 2.51 | 2.80 | 2.73 |
| 100 (Inv.) | 60 | 60 | | 10.7 | 47 | 2.49 | 2.78 | 2.71 |
| 101 (Inv.) | 60 | 60 | | 11.0 | 45 | 2.49 | 2.77 | 2.68 |
| 102 (Inv.) | 60 | 60 | | 12.0 | 42 | 2.49 | 2.75 | 2.67 |
| 103 (Inv.) | 60 | 60 | Sulfate of | 10.2 | 94 | 2.51 | 2.83 | 2.74 |
| 104 (Inv.) | 60 | 60 | Exemp. | 10.3 | 70 | 2.51 | 2.83 | 2.73 |
| 105 (Inv.) | 60 | 60 | compound (3) | 10.5 | 63 | 2.50 | 2.81 | 2.73 |
| 106 (Inv.) | 60 | 60 | | 10.7 | 46 | 2.50 | 2.81 | 2.72 |
| 107 (Inv.) | 60 | 60 | | 11.0 | 44 | 2.49 | 2.80 | 2.72 |
| 108 (Inv.) | 60 | 60 | | 12.0 | 42 | 2.49 | 2.80 | 2.72 |
| 109 (Inv.) | 60 | 60 | Sulfate of | 10.2 | 89 | 2.52 | 2.84 | 2.76 |
| 110 (Inv.) | 60 | 60 | Exemp. | 10.3 | 65 | 2.52 | 2.83 | 2.74 |
| 111 (Inv.) | 60 | 60 | compound (5) | 10.5 | 63 | 2.51 | 2.82 | 2.73 |
| 112 (Inv.) | 60 | 60 | | 10.7 | 48 | 2.51 | 2.76 | 2.67 |
| 113 (Inv.) | 60 | 60 | | 11.0 | 46 | 2.50 | 2.73 | 2.64 |
| 114 (Inv.) | 60 | 60 | | 12.0 | 44 | 2.50 | 2.72 | 2.63 |

As is obvious from Table 4, it was found that, in the colour developers each containing hydroxylamine sulfate, when raising the pH of the colour developers, the maximum colour densities were seriously lowered in both of the green- and red-sensitive emulsion layers each comprising silver chlorbromide having a relatively lower silver bromide content and, on the other hand, when the preservatives of the invention were used, no maximum colour density was lowered and rapid processing was performable,

EXAMPLE 5

The came processing as in Example 1 was repeatedly applied to the samples prepared by changing the silver bromide contents to 40 mol % from those of the green- and red-sensitive silver chlorobromide emulsions of the light-sensitive materials used in Example 1, provided therein that the pH of the colour developer used and the preservatives used in the colour developers were changed as shown in Table 5. Next, the colour developers were allowed to stand at 35° C. for one week and were then applied again to further treatments. The both of the minimum reflection densities of the magenta dyes were compared.

The results thereof are shown in Table 5 below.

TABLE 5

| Experiment No. | Preservative (g/liter) | pH | Min. magenta dye density: Before storage | Min. magenta dye density: After storage |
|---|---|---|---|---|
| 115 (Comp.) | Hydroxyl- | 10.2 | 0.04 | 0.05 |
| 116 (Comp.) | amine | 10.3 | 0.04 | 0.07 |
| 117 (Comp.) | sulfate | 10.5 | 0.04 | 0.07 |
| 118 (Comp.) | (2 g/liter) | 10.7 | 0.04 | 0.08 |
| 119 (Comp.) | | 11.0 | 0.05 | 0.09 |
| 120 (Comp.) | | 12.0 | 0.05 | 0.09 |
| 121 (Inv.) | Phosphate of | 10.2 | 0.04 | 0.05 |
| 122 (Inv.) | Exemplified | 10.3 | 0.04 | 0.06 |
| 123 (Inv.) | compound (1) | 10.5 | 0.04 | 0.06 |

TABLE 5-continued

| Experiment No. | Preservative (g/liter) | pH | Min. magenta dye density Before storage | After storage |
|---|---|---|---|---|
| 124 (Inv.) | (2 g/liter) | 10.7 | 0.04 | 0.06 |
| 125 (Inv.) | | 11.0 | 0.05 | 0.07 |
| 126 (Inv.) | | 12.0 | 0.05 | 0.07 |
| 127 (Inv.) | Phosphate of | 10.2 | 0.04 | 0.05 |
| 128 (Inv.) | Exemplified | 10.3 | 0.04 | 0.05 |
| 129 (Inv.) | compound (3) | 10.5 | 0.04 | 0.05 |
| 130 (Inv.) | (2 g/liter) | 10.7 | 0.04 | 0.05 |
| 131 (Inv.) | | 11.0 | 0.04 | 0.06 |
| 132 (Inv.) | | 12.0 | 0.05 | 0.07 |
| 133 (Inv.) | Phosphate of | 10.2 | 0.04 | 0.05 |
| 134 (Inv.) | Exemplified | 10.3 | 0.04 | 0.05 |
| 135 (Inv.) | compound (5) | 10.5 | 0.04 | 0.06 |
| 136 (Inv.) | (2 g/liter) | 10.7 | 0.04 | 0.07 |
| 137 (Inv.) | | 11.0 | 0.05 | 0.08 |
| 138 (Inv.) | | 12.0 | 0.05 | 0.08 |

As is obvious from Table 5, it is found that the coloue developers each containing the preservative of the invention has an excellent preservability for a long standing, because fog is produced a little in a light-sensitive material processed after allowing it to stand even if a pH value is raised.

EXAMPLE 6

There used the same sample as the light-sensitive material used in Example 1, except that the silver bromide contents each in the green- and red-sensitive emulsions thereof were changed to 30 mol %, respectively, and the same treatments as in Example 1 were applied repeatedly.

Wherein, however, the colour developing agent and the preservatives each to be contained in the colour developer were changed as indicated in Table 5 and the amount of benzyl alcohol added was also changed as indicated in Table 6.

Next, the colour developer was allowed to stand at 35° C. for one week and was then used in the treatments again. Both of the minimum reflection densities of the magenta dyes obtained before and after storage were compared, in the same manner as in Example 5.

The results thereof are shown in Table 6.

TABLE 6

| Experiment No. | Color developing agent (g/liter) | Benzyl alcohol (ml/liter) | Preservative (g/) | Minimum magenta dye density Before storage | After storage |
|---|---|---|---|---|---|
| 139 | N,N-diethylpara-phenylenediamine sulfate (5.0 g/liter) | 0 | Exemplified compound (1) | 0.05 | 0.10 |
| 140 | Exemplified color developing agent (3) (5.0 g/liter) | 0 | (3.0 g/liter) | 0.04 | 0.08 |
| 141 | Exemplified color developing agent (4) (5.0 g/liter) | 0 | | 0.04 | 0.08 |
| 142 | Exemplified color developing agent (5) (5.0 g/liter) | 0 | | 0.04 0.08 | |
| 143 | Exemplified color developing agent (1) (5.0 g/liter) | 0 | | 0.04 | 0.06 |
| 144 | Exemplified color developing agent (1) (5.0 g/liter) | 5 | | 0.04 | 0.06 |
| 145 | Exemplified color developing agent (1) (5.0 g/liter) | 14 | | 0.04 | 0.08 |
| 146 | Same as in 102 | 0 | Exemplified | 0.05 | 0.10 |
| 147 | Same as in 103 | 0 | compound (3) | 0.04 | 0.07 |
| 148 | Same as in 104 | 0 | (3.0 g/liter | 0.04 | 0.07 |
| 149 | Same as in 105 | 0 | | 0.04 | 0.07 |
| 150 | Same as in 106 | 0 | | 0.04 | 0.06 |
| 151 | Same as in 107 | 5 | | 0.04 | 0.06 |
| 152 | Same as in 108 | 14 | | 0.04 | 0.07 |
| 153 | Same as in 102 | 0 | Exemplified | 0.05 | 0.11 |
| 154 | Same as in 103 | 0 | compound (5) | 0.04 | 0.08 |
| 155 | Same as in 104 | 0 | (3.0 g/liter) | 0.04 | 0.08 |
| 156 | Same as in 105 | 0 | | 0.04 | 0.08 |
| 157 | Same as in 106 | 0 | | 0.04 | 0.07 |
| 158 | Same as in 107 | 5 | | 0.04 | 0.07 |
| 159 | Same as in 108 | 14 | | 0.04 | 0.09 |

As is obvious from Table 6, it is found that, when using a colour developing agent not containing any water-soluble group, fogg is remarkably produced in a light-sensitive material processed after allowing to stand and, on the other hand, when using the exemplified colour developing agent of the invention, fog is produced a little and that the less the benzyl alcohol is added, the less the fog is produced.

What is claimed is:

1. A method of processing a silver halide color photographic light sensitive material having a color coupler and having a plurality of silver halide emulsion layers, comprising the steps of exposing said material imagewise to light and then processing the material in at least one color developing step, wherein:

(1) the silver halide contained in said plurality of silver halide emulsion layers is substantially silver chlorobromide;

(2) at least one of said plurality of silver halide emulsion layers contains silver chlorobromide having a silver chloride content of not less than 60 mol %; and (3) a color developer used in said color developing step contains a paraphenylenediamine type color developing agent having at least one hydrophilic group on the amino group or the benzene nucleus thereof, and at least one compound represented by the formula I:

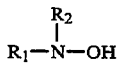

(I)

wherein $R_1$ and $R_2$ each represents an alkyl group having 1 to 3 carbon atoms and at least one of $R_1$ and $R_2$ is substituted with a sulfonic acid group or a carboxylic acid group and $R_1$ and $R_2$ are capable of together forming a ring.

2. The method of processing a silver halide color photographic light-sensitive material as claimed in claim 1 wherein said color developer contains at least one paraphenylenediamine type color developing agent having at least one alkylsulfonamidoalkyl group on the benzene ring, on the amino group or on both the benzene ring and the amino group thereof.

3. The method of claim 1, wherein the compound of the formula I, at least one of $R_1$ and $R_2$ is substituted with a sulfonic acid group.

* * * * *